United States Patent [19]

Tsukada et al.

[11] 4,095,525

[45] Jun. 20, 1978

[54] PROTECTIVE COATING MATERIAL FOR LITHOGRAPHIC PRINTING PLATE

[75] Inventors: Norishige Tsukada, Nishinomiya; Kazuo Hagihara, Tokyo; Kozo Tsuji, Takatsuki; Masanori Fujimoto, Ibaraki; Tsuneyuki Nagase, Takatsuki, all of Japan

[73] Assignees: Sumitomo Chemical Company, Limited, Osaka; Hayashibara Biochemical Laboratories, Inc., both of Japan

[21] Appl. No.: 734,356

[22] Filed: Oct. 20, 1976

[30] Foreign Application Priority Data

Oct. 31, 1975 Japan ..... 50-131692

[51] Int. Cl.[2] ..... B41N 3/08

[52] U.S. Cl. ..... 101/465; 101/451; 106/2

[58] Field of Search ..... 106/2, 162; 101/451, 101/463, 464, 465; 427/156; 195/31 P

[56] References Cited

U.S. PATENT DOCUMENTS

| | | | |
|---|---|---|---|
| 2,569,488 | 10/1951 | Newman | 101/451 |
| 3,354,824 | 11/1967 | Griffith et al. | 106/2 |
| 3,784,390 | 1/1974 | Hijiya et al. | 106/213 |
| 3,870,537 | 3/1975 | Hijiya et al. | 106/162 |
| 3,888,809 | 6/1975 | Nakashio et al. | 106/162 |

*Primary Examiner*—Lorenzo B. Hayes
*Attorney, Agent, or Firm*—Stevens, Davis, Miller & Mosher

[57] ABSTRACT

A protective coating material for lithographic printing plate, which comprises pullulan or pullulan derivatives. Said material is superior to hitherto used gum arabic solution in the protection of the surface of lithographic printing plate against oxidation and scumming as well as in the ability to enhance the hydrophilic character of metallic surface of a non-image area.

4 Claims, No Drawings

PROTECTIVE COATING MATERIAL FOR LITHOGRAPHIC PRINTING PLATE

This invention relates to a protective coating material for lithographic printing plate, which is characterized by containing pullulan or a pullulan derivative.

In offset printing using a lithographic printing plate wherein ink-receptive image areas and ink-repellent non-image areas are formed on a zinc or aluminium plate, the prepared lithographic plate is coated with some kind of protective coating material to be finished finally and to be protected from deterioration throughout the printing process. The coating is carried out with the following aims:

(1) protection of the plate surface (protection against oxidation and scumming), (2) enhancement of the hydrophilic character of the metallic surface which is a non-image area.

Usually, a solution of gum arabic is used for protecting such lithographic printing plate surfaces. However, gum arabic which is a naturally occurring product has disadvantages in that it is unstable in its quality, has a high content of impurities, cannot be dissolved without much time and labor, and deteriorates with the lapse of time to increase acidity which causes scumming of the non-image areas. Further, gum arabic is poor in film-forming ability so that, particularly when the gum arabic solution is coated too thickly, the resulting coating film can form cracks through which the surface of the metallic plate is oxidized to cause a scumming at the time of printing. Further, the protecting film of gum arabic cannot readily be washed off with water prior to printing, and therefore gum arabic remains in the non-image areas of plate to cause scumming, and moreover it remains on the image areas to be inked, resulting in an insufficient ink-receptivity (blinding) at the time of printing. Further, gum arabic tends to coagulate in a fountain solution of alcohol (damping water), if its concentration is improper.

The present inventors have conducted extensive studies to improve the above-mentioned disadvantages, and have found out that the above-mentioned disadvantages, can be improved by using a solution of pullulan or pullulan derivatives as a film-forming solution in lithographic printing.

It is an object of the invention to provide a novel film-forming solution for use in lithographic printing.

It is another object of the invention to provide a method of lithographic printing, which comprises using an aqueous solution of pullulan or pullulan derivatives for coating or damping a non-image area of a lithographic printing plate.

The pullulan to be used in the invention is known, and is not particularly restricted to its preparation process. For example, pullulan described in U.S. Pat. No. 3,888,809 can be used. Although the properties of pullulan may vary somewhat according to bacterial strain by which it is produced, pullulan produced by any strain can be used in this invention. Pullulan used in this invention is not limited to any particular weight. Preferably, however, it has a molecular weight of $1 \times 10^4$ to $200 \times 10^4$, particularly $3 \times 10^4$ to $60 \times 10^4$.

In the invention, pullulan derivatives such as alkyl, hydroxyalkyl, carboxyl, sulfonic or amino group substituted pullulan may also be used as long as the derivatives are readily soluble in water. It is desirable in this invention that pullulan or the pullulan derivative can readily be absorbed to the metallic surface enough to enhance the hydrophilic character of the metallic surface of a non-image area. From this point of view, it is preferable to use pullulan derivatives such as carboxyl group, sulfonic group or amino group substituted pullulan. In order to promote the adsorption of pullulan or pullulan derivative to the metallic surface, it is also permitted to incorporate into pullulan or pullulan derivative at least one member selected from phosphoric acid, ammonium phosphate, ammonium nitrate, acetic acid and the like as an additive. The amount of said additive is preferably in the range of 0.1 to 20% by weight based on the weight of pullulan.

In preparing the protective coating liquid material for lithographic printing plates, the pullulan or derivative thereof is dissolved in water. The concentration of said solution may be dependent on the molecular weight of the pullulan or pullulan derivatives. However, pullulan or pullulan derivatives having any molecular weight can be used if the concentration of the solution is controlled so as to give a solution viscosity of 10 to 100 cp, preferably about 25 to 60 cp at 20° C. In the case of pullulan itself, a solution having a viscosity of about 46 cp can be prepared by adjusting the concentration as follows:

| Molecular weight of pullulan | Concentration |
|---|---|
| 10,000 | 23% w/v |
| 38,000 | 19% w/v |
| 50,000 | 17% w/v |
| 70,000 | 16% w/v |

wherein % w/v represents the weight (*g*) of solute in 100 milliliter of solution.

The resulting aqueous solution of pullulan or pullulan derivatives can be used effectively for coating a non-image area of a lithographic printing plate. For example, the aqueous solution can be applied for desensitization and/or gumming up of the lithographic printing plate and also for use as damping water to enhance the hydrophilic character of a non-image area, in a conventional manner, for example, described in "Offset Lithographic Platemaking" by Robert F. Reed, issued by The Graphic Arts Technical Foundation (GATF).

The present invention is explained in more detail with reference to the following Recipe Examples and Examples which are only illustrative but not limitative on the scope of the present invention.

EXAMPLE 1

Pullulan having a molecular weight of 38,000 is dissolved into water to give a 19% solution.

RECIPE EXAMPLE 2

Carboxylated pullulan having a molecular weight of 32,000 (carboxyl content 0.5% by weight) is dissolved into water to give a 20% solution. This solution had a viscosity of 46 cp.

RECIPE EXAMPLE 3

| | |
|---|---|
| Phosphoric acid (85%) | 35 ml |
| Ammonium phosphate | 50 g |
| Ammonium nitrate | 50 g |

The above-mentioned mixture is dissolved into water to give a total volume of 1000 ml (Solution A).

On the other hand, carboxylated pullulan having a molecular weight of 21,000 (carboxyl content 3% by weight) is dissolved into water to give a 22% solution. This solution (Solution B) had a viscosity of 46 cp.

Solution A is mixed with 3500 ml of Solution B and the pH value of the mixture is adjusted to 5.0.

RECIPE EXAMPLE 4

| | |
|---|---|
| Phosphoric acid (85%) | 50 ml |
| Glacial acetic acid | 18 ml |

The above-mentioned mixture is dissolved into water to give a total volume of 1000 ml (Solution C).

Solution C is mixed with 3500 ml of Solution B and the pH value of the mixture is adjusted to 5.0.

RECIPE EXAMPLE 5

25 ml of phosphoric acid (specific gravity 1.12) is added to 1000 ml of the aqueous solution of Recipe Example 2.

EXAMPLE 1

A photosensitive PVA solution (manufactured by Koyo Chemical Industry Co.) was coated on an aluminium plate which had been grained to make the surface fineness 600 mesh. After exposing and etching followed by lacquering and inking, the non-image area was stripped off to obtain an aluminum deep-etch plate. The plate was separated into two parts, on one of which was coated the aqueous pullulan solution of Recipe Example 1 and on the other of which was coated a 14° Be' aqueous solution of gum arabic to find any difference between them. After 24 hours, the plate was tested for actual printing.

As the result, no scumming was observed in the non-image area of both parts. Regarding plugging or bridging with ink in the shadow, the result was better in the part coated with the pullulan solution than in the part coated with the gum arabic solution.

EXAMPLE 2

An Olympic plate (manufactured by Horson Algraphy Ltd.) was exposed to light and developed.

To the plate thus prepared was uniformly applied the aqueous solution of carboxylated pullulan of Recipe Example 2 which was dried, whereby a thick pullulan film was made on the non-image area, but not on the image area. Thereafter the whole surface of the plate was coated with EGGEN LACQUER® (manufactured by Eggen, West Germany) so as to form a thin-skinned film, and dried.

Thereafter, water was poured on the plate, and then water penetrated through the lacquer film and began to swell the pullulan film on the non-image area. After water was absorbed enough to swell the pullulan film, the lacquer film together with the pullulan film could be removed very easily with a sponge impregnated with water. As a result, the lacquer film remained only on the image area.

As above, the aqueous solution of carboxylated pullulan can satisfactorily function as a protective film-forming solution in the so-called lacquer replacement treatment of image on a presensitized plate to protect the non-image area against lacquer.

EXAMPLE 3

An aluminium deep-etch plate was prepared by repeating the procedure of Example 1. The solution of Recipe Example 5 was applied to the plate as an etching gum solution.

The plate was tested for actual printing to examine dot-enlargement and plugging or bridging with ink in the shadow part. There was observed no dot-enlargement nor plogging or bridging with ink, and the solution was proved to be sufficiently effective as an etching gum solution.

EXAMPLE 4

An aqueous solution prepared according to Recipe Example 3 was used as a damping water.

Using an Olympic plate (manufactured by Horson Algraphy Ltd.), printing was carried out by means of a Pearl printer (manufactured by Color Metal S.A.).

After printing 20,000 sheets, there were observed no scum in the non-image area nor plugging or bridging in the shadow, and the solution was proved to be sufficiently effective as a damping water.

What is claimed is:

1. In a process for lithographic printing which comprises forming ink-receptive image areas and ink-repellent non-image areas on a metallic lithographic plate, coating the non-image areas of said plate with a film-forming material to enhance the hydrophilic character of the ink-repellent non-image areas of said plate and protect said plate from chemical or mechanical damage, applying a hydrophobic ink to said plate and then printing upon a substance with said plate; the improvement comprising coating said non-image areas with an aqueous solution of pullulan or a pullulan derivative having a viscosity in the range of 10 to 100 cp at a temperature of 20° C.

2. A process according to claim 1, wherein the molecular weight of said pullulan is in the range of $1 \times 10^4$ to $200 \times 10^4$.

3. A process according to claim 1, wherein the pullulan derivative is pullulan substituted by an alkyl, hydroxyl, carboxyl, sulfonic or amino group.

4. A process according to claim 1, wherein said aqueous solution of pullulan or a pullulan derivative further contains phosphoric acid, ammonium phosphate, ammonium nitrate or acetic acid in an amount of 0.1 to 20% by weight based on the weight of pullulan or pullulan derivative.

* * * * *